US007722180B2

(12) United States Patent
Mashima

(10) Patent No.: US 7,722,180 B2
(45) Date of Patent: May 25, 2010

(54) LIQUID DROPLET DISCHARGE APPARATUS INCLUDING DUPLEX RECORDING MEDIUM TRANSPORT UNIT

(75) Inventor: Masao Mashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 792 days.

(21) Appl. No.: 11/351,970

(22) Filed: Feb. 10, 2006

(65) Prior Publication Data

US 2007/0008394 A1 Jan. 11, 2007

(30) Foreign Application Priority Data

Jul. 5, 2005 (JP) ..... 2005-196103

(51) Int. Cl.
*B41J 2/01* (2006.01)

(52) U.S. Cl. ..... 347/104; 347/16; 271/65; 271/197; 271/291; 271/296; 355/26; 399/374; 399/402; 209/584

(58) Field of Classification Search ..... 271/65, 271/197, 291, 296; 355/26; 399/374, 402; 209/584

See application file for complete search history.

(56) References Cited

U.S. PATENT DOCUMENTS 3,227,444 A * 1/1966 Egan ..... 271/65
4,453,841 A * 6/1984 Bobick et al. ..... 347/16
4,553,831 A * 11/1985 Dixon ..... 355/26
5,324,024 A * 6/1994 Mori ..... 271/296
5,447,303 A * 9/1995 Smith ..... 271/291
5,460,273 A * 10/1995 Stevens et al. ..... 209/584
6,250,754 B1 * 6/2001 Bortolotti ..... 347/104
2004/0245711 A1 * 12/2004 Domoto et al. ..... 271/197
2006/0050126 A1 * 3/2006 Tanaka et al. ..... 347/104
2006/0170748 A1 * 8/2006 Jones et al. ..... 347/104

FOREIGN PATENT DOCUMENTS

JP 2001-287873 10/2001

* cited by examiner

*Primary Examiner*—Matthew Luu
*Assistant Examiner*—John P Zimmermann
(74) *Attorney, Agent, or Firm*—Fildes & Outland, P.C.

(57) ABSTRACT

A liquid droplet discharge apparatus includes a conveyor belt that retains and conveys a recording medium, a liquid droplet discharge head that discharges liquid droplets onto the recording medium retained on the conveyor belt, a discharge belt that moves to a recording medium feeding position of the conveyor belt, receives the recording medium, and retains and conveys the recording medium to a discharge port; and an inversion belt that moves to the recording medium feeding position, receives and retains the recording medium, and feeds the recording medium to an inversion path. By disposing the inversion belt, the conveyance direction of the recording medium can be switched without contacting the recording surface of the recording medium, and even when two-sided printing is to be conducted at a high speed, the inversion belt does not become soiled by the liquid droplets adhering to the recording surface of the recording medium.

11 Claims, 8 Drawing Sheets

LIQUID DROPLET DISCHARGE APPARATUS INCLUDING DUPLEX RECORDING MEDIUM TRANSPORT UNIT

CROSS-REFERENCE TO RELATED APPLICATION

This application claims priority under 35 USC 119 from Japanese Patent Application No. 2005-196103, the disclosure of which is incorporated by reference herein.

BACKGROUND OF THE INVENTION

1. Field of the Invention

The present invention relates to a liquid droplet discharge apparatus applied to image recording apparatus or the like which record images by discharging ink droplets from a recording head onto a recording medium that is retained and conveyed by a conveyor belt.

2. Description of the Related Art

In image recording apparatus of the inkjet format which record an image on paper by discharging ink from a recording head, a printing format called serial scanning, in which printing is conducted one line at a time by reciprocally moving the recording head in the direction orthogonal to the conveyance direction of the paper while conveying the paper, is widely used mainly for personal use.

Further, in recent years, image recording apparatus of the so-called full-line head format have become commercially available. Here, a non-scanning-type recording head is used which corresponds to the width of the paper and includes numerous nozzles that are arranged along the direction (width direction) orthogonal to the conveyance direction of the paper. An image is recorded while the paper is continuously conveyed, whereby the printing speed is improved, and office use can also be accommodated.

Incidentally, in two-sided printing mechanisms using such inkjet recording technology, when printing is conducted on one side of the paper, the ink on that side does not dry immediately thereafter, and when printing is to be conducted on the other side of the paper, conventionally printing on the other side of the paper is conducted after the ink on the one side of the paper dries. For this reason, different actions have been taken, such as setting the drying time and speeding up drying by lowering the printing density on the surface of the paper, but there have been instances where these actions have led to a decline in productivity and a decline in image quality.

For this reason, in Japanese Patent Application Publication (JP-A) No. 2001-287873, a configuration is described where an inversion standby position is disposed at a position that does not interfere with a sheet of paper following a prior sheet of paper for which one-sided printing has ended. The switching of the conveyance path is done with a branch pawl, and in recording apparatus that conduct two-sided printing at a high speed, the undried ink may contact with the branch pawl or the conveyance path and soiling of the conveyance roll pairs can arise.

SUMMARY OF THE INVENTION

In view of these circumstances, the present invention provides a liquid droplet discharge apparatus that can conduct an inversion operation without contacting the recording surface of paper for which one-sided printing has ended.

One aspect of the invention is a liquid droplet discharge apparatus including a conveyance member that retains and conveys a recording medium, a liquid droplet discharge head that discharges liquid droplets onto the recording medium retained on the conveyance member; a discharge member that moves to a recording medium feeding position of the conveyance member, receives the recording medium, and retains and conveys the recording medium to a discharge port; and an inversion member that moves to the recording medium feeding position, receives and retains the recording medium, and feeds the recording medium to an inversion path.

BRIEF DESCRIPTION OF THE DRAWINGS

An embodiment of the present invention will be described in detail based on the following figures, wherein.

DETAILED DESCRIPTION OF THE INVENTION

An inkjet recording apparatus 10, to which a liquid droplet discharge apparatus pertaining to an embodiment of the invention is applied, will be described below with reference to the drawings.

Figure 1:
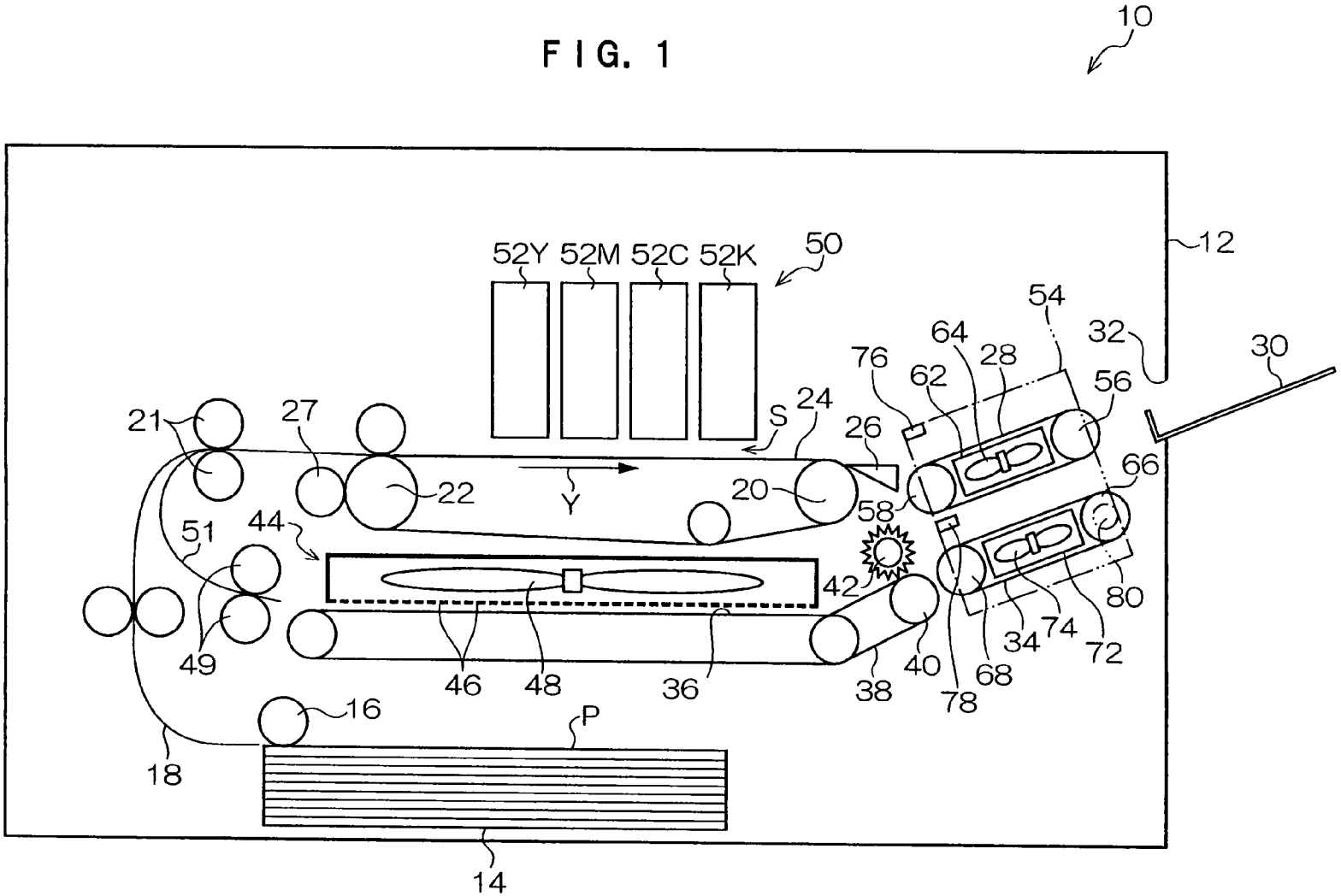
FIG. 1 is a configural diagram showing the schematic configuration of a liquid droplet discharge apparatus pertaining to the embodiment of the invention.

FIG. 1 shows the inkjet recording apparatus 10 serving as the liquid droplet discharge apparatus pertaining to the embodiment of the invention.

The inkjet recording apparatus 10 includes an apparatus body (casing) 12. A paper supply tray 14, in which sheets of paper P are placed in a bundle and accommodated, is disposed in a lower portion inside the apparatus body 12. A paper supply roll 16 is disposed above the leading end portion of the paper supply tray 14. The paper supply roll 16 pressingly contacts the leading end of the upper surface of the paper bundle inside the paper supply tray 14 and rotates a predetermined amount in a printing operation resulting from the inkjet recording apparatus 10, whereby the paper supply roll 16 removes the uppermost sheet of paper P one sheet at a time from the paper supply tray 14 and feeds it to a conveyance path 18.

The conveyance path 18 curves in a substantial U-shape such that it proceeds upward from the vicinity of the paper supply roll 16 and then becomes substantially parallel to the paper supply tray 14. An endless conveyor belt 24 that is stretched between a drive roll 20 and a driven roll 22 is disposed above the paper supply tray 14 at the downstream side of the conveyance path 18 (downstream along the conveyance direction of the paper P to be conveyed).

The drive roll 20 positioned downstream in the conveyance direction of the paper P and the driven roll 22 positioned upstream in the conveyance direction of the paper P are disposed in parallel a predetermined distance apart from each other in a substantially horizontal plane. Thus, the upper portion of the conveyor belt 24 is substantially horizontally planar, and the conveyor belt 24 rotates and moves in a predetermined direction (clockwise direction in FIG. 1) as a result of the drive roll 20 being rotated and driven by an unillustrated belt drive motor.

A belt comprising a chargeable material such as a semiconductive polyimide material (surface resistance of $10^8$ to $10^{13}$ Ω/sq. and a volume resistance of $10^9$ to $10^{14}$ Ω·cm) formed to a thickness of 75 μm, a width of 380 mm, and a circumferential length of 1000 mm can be used for the conveyor belt 24. Also, an SUS roll of ϕ 50 mm can be used for the drive roll 20 and the driven roll 22.

A charge roll 27 that forms a pair with the driven roll 22 is disposed at the most upstream portion of the conveyor belt 24. An unillustrated power supply is connected to the charge roll 27, and the driven roll 22 is electrically connected to a frame ground.

A registration roll pair 21 is disposed upstream of the pair comprising the charge roll 27 and the driven roll 22. The registration roll pair 21 temporarily stops the paper P fed from the upstream side of the conveyance path 18, corrects the position (orientation) of the paper P, and feeds the paper P to the conveyor belt 24 at a predetermined timing.

The charge roll 27 nips the conveyor belt 24 between itself and the driven roll 22, and a predetermined electric potential difference arises between the charge roll 27 and the grounded driven roll 22. Thus, a charge is imparted to the conveyor belt 24, the paper P becomes electrostatically adhered to the conveyor belt 24, and the paper P is conveyed in the direction of arrow Y in accompaniment with the rotational movement of the conveyor belt 24.

A roll of ϕ 10 to 25 mm adjusted to a volume resistivity of $10^6$ to $10^8$ Ω·cm comprising an elastic layer in which a conductivity-imparting material is dispersed formed on a rod-like or pipe-like outer peripheral surface whose material is aluminium or stainless steel can be used for the charge roll 27.

For the elastic layer, a resin material such as a urethane resin, a thermoplastic elastomer, an epichlorohydrin rubber, an ethylene-propylene-diene copolymer rubber, a silicon rubber, an acrylonitrile-butadiene copolymer rubber, or a polynorbornene rubber is used singly or in combination of two or more. As a preferable material, there is urethane foam resin.

For the urethane foam resin, a resin to which an independent air bubble structure is imparted by mixing and dispersing hollow bodies such as hollow glass beads or heat-expanding microcapsules in a urethane resin is preferable. Such a urethane foam resin has a low hardness elasticity that is preferable as the charge roll, is highly stable in terms of its contact with respect to the conveyor belt 24, and is also excellent in terms of its ability to form a nip.

The surface of the elastic layer may be covered with a water-repellent skin layer with a thickness of 5 to 100 μm. This is effective for suppressing characteristic changes (resistance changes) resulting from humidity changes inside the apparatus and the adhesion of ink mist to the charge layer surface.

A recording head unit 50 is disposed above the conveyor belt 24 facing the surface of the upper portion of the planar conveyor belt 24. The recording head unit 50 includes, in order from upstream in the rotation direction of the conveyor belt 24 (conveyance direction of the paper P), recording heads 52Y, 52M, 52C and 52K that are disposed along the rotational movement direction of the conveyor belt 24. The recording heads 52Y, 52M, 52C and 52K form a full-color image on the paper P by respectively discharging ink droplets of the four colors of yellow (Y), magenta (M), cyan (C) and black (K) at predetermined timings onto the paper P conveyed by the conveyor belt 24. The format by which the recording heads 52Y to 52K of the respective colors discharge the ink droplets is not limited; known formats such as the thermal format or the piezoelectric format can be applied.

Unillustrated ink tanks that respectively store inks of the four colors of yellow, magenta, cyan, and black are disposed in the apparatus body 12. The inks of the respective colors are supplied from the ink tanks through pipes to the recording heads 52Y to 52K. Known inks, such as water-based inks, oil-based inks, and solvent inks, can be used for the inks.

In the inkjet recording apparatus 10 of the present embodiment, each of the recording heads 52Y to 52K of the respective colors form a long non-scanning-type line head that extends along the width direction orthogonal to the rotational movement direction of the conveyor belt 24 and is slightly longer than the width dimension of the conveyor belt 24.

The recording heads 52Y to 52K include nozzle formation surfaces (in FIG. 1, the undersurfaces of the recording heads 52Y to 52K) in which plural nozzles are arranged at predetermined intervals along the width direction of the recording heads 52Y to 52K. The effective printing width resulting from the plural nozzles is equal to or greater than the width dimension of the paper P conveyed by the conveyor belt 24.

The space between the recording heads 52Y to 52K and the conveyor belt 24 is an image recording section (printing region S). In this image recording section, ink droplets are discharged from the nozzles of the recording heads 52Y to 52K and an image is formed on the paper P, which is adhered to the surface of the upper portion of the conveyor belt 24 and conveyed from upstream in the conveyance direction to downstream (in the direction of arrow Y in FIG. 1) in accompaniment with the rotational movement of the conveyor belt 24.

The recording heads 52Y to 52K of the respective colors are connected to a control unit (not shown) that controls the operation of each portion of the inkjet recording apparatus 10. The ink discharge operation is controlled by this control unit. The control unit determines the discharge timing of the ink droplets and the nozzles to be used in accordance with image information included in an inputted print job, for example, and controls ink discharge by transmitting drive signals to the recording heads 52Y to 52K. The control unit also controls the timing at which the paper P is fed by rotating and controlling the registration roll pair 21 such that the ink discharge operation and the movement of the paper P become synchronous, and controls the rotational movement operation of the conveyor belt 24 by driving and controlling the belt drive motor.

A separation pawl 26 is disposed downstream of the conveyor belt 24. The image-recorded paper P is separated from the conveyor belt 24 by the separation pawl 26, and the paper P, on one side of which printing has been conducted, is fed. The position where paper P is fed from the conveyor belt 24 is designated as feeding position of the conveyor belt 24).

A discharge conveyor belt 28 is configured to be movable downstream of the separation pawl 26 (described later). In the case of one-sided printing (where an image is recorded on one side of the paper P), the paper P is discharged to a discharge tray 30 disposed in a side surface of the apparatus body 12. Thus, the paper P separated by the separation pawl 26 is received by the discharge conveyor belt 28 and guided to a discharge port 32.

An inversion conveyor belt 34 is disposed below the discharge conveyor belt 28. In the case of two-sided printing, the inversion conveyor belt 34 is disposed in the paper feeding position in a state where the discharge conveyor belt 28 is evacuated from the paper feeding position of the conveyor belt 24, and the paper P, on one side of which printing has been conducted, is received and temporarily retained by the inversion conveyor belt 34 (described later).

Incidentally, a two-sided conveyor belt 36 that conveys the paper P retained on the inversion conveyor belt 34 in the direction opposite to the direction of arrow Y is disposed between the conveyor belt 24 and the paper supply tray 14. An intermediate conveyor belt 38 is disposed between the two-sided conveyor belt 36 and the inversion conveyor belt 34.

The intermediate conveyor belt 38 includes a circular column-like elastic roll 40 whose outer peripheral layer is formed by an elastic material such as rubber. Although it is not illustrated, an angled protrusion is formed continuously along the circumferential direction on the outer peripheral surface of the elastic roll 40. The elastic roll 40 forms a pair with a spur 42, which comprises a liquid-repellent coating layer formed on the surface of the protrusion, and the elastic roll 40 guides, conveys, and reliably feeds the paper P, on one side of which printing has been conducted, to the two-sided conveyor belt 36.

Here, a substantially box-like air blowing unit 44 is disposed between the two-sided conveyor belt 36 and the conveyor belt 24. Plural blow holes 46 are formed in the bottom surface of the air blowing unit 44 facing the surface of the upper portion of the two-sided conveyor belt 36.

A blower 48 is disposed inside the air blowing unit 44. The wind formed by the blower 48 is blown through the blow holes 46 toward the two-sided conveyor belt 36. Thus, wind is blown toward the recording surface of the paper P conveyed by the two-sided conveyor belt 36, so that the drying speed of the paper P is accelerated.

A two-sided conveyance path 51 that is formed in a substantial U-shape in order to invert the paper P, on one side of which printing has been conducted, is disposed downstream of the two-sided conveyor belt 36. The paper P fed from the two-sided conveyor belt 36 is guided to the two-sided conveyance path 51 by a conveyance roll pair 49 and inverted.

The two-sided conveyance path 51 merges with the conveyance path 18 positioned upstream of the registration roll pair 21. The inverted paper P again passes through the printing region S via the registration roll pair 21, so that image recording is conducted on the other side of the paper P. Then, the paper P, on both sides of which printing is completed, is received by the discharge conveyor belt 28 moved to the paper feeding position of the conveyor belt 24 and is discharged to the discharge tray 30 via the discharge port 32.

Here, the discharge conveyor belt 28 and the inversion conveyor belt 34 will be described.

Figure 2:
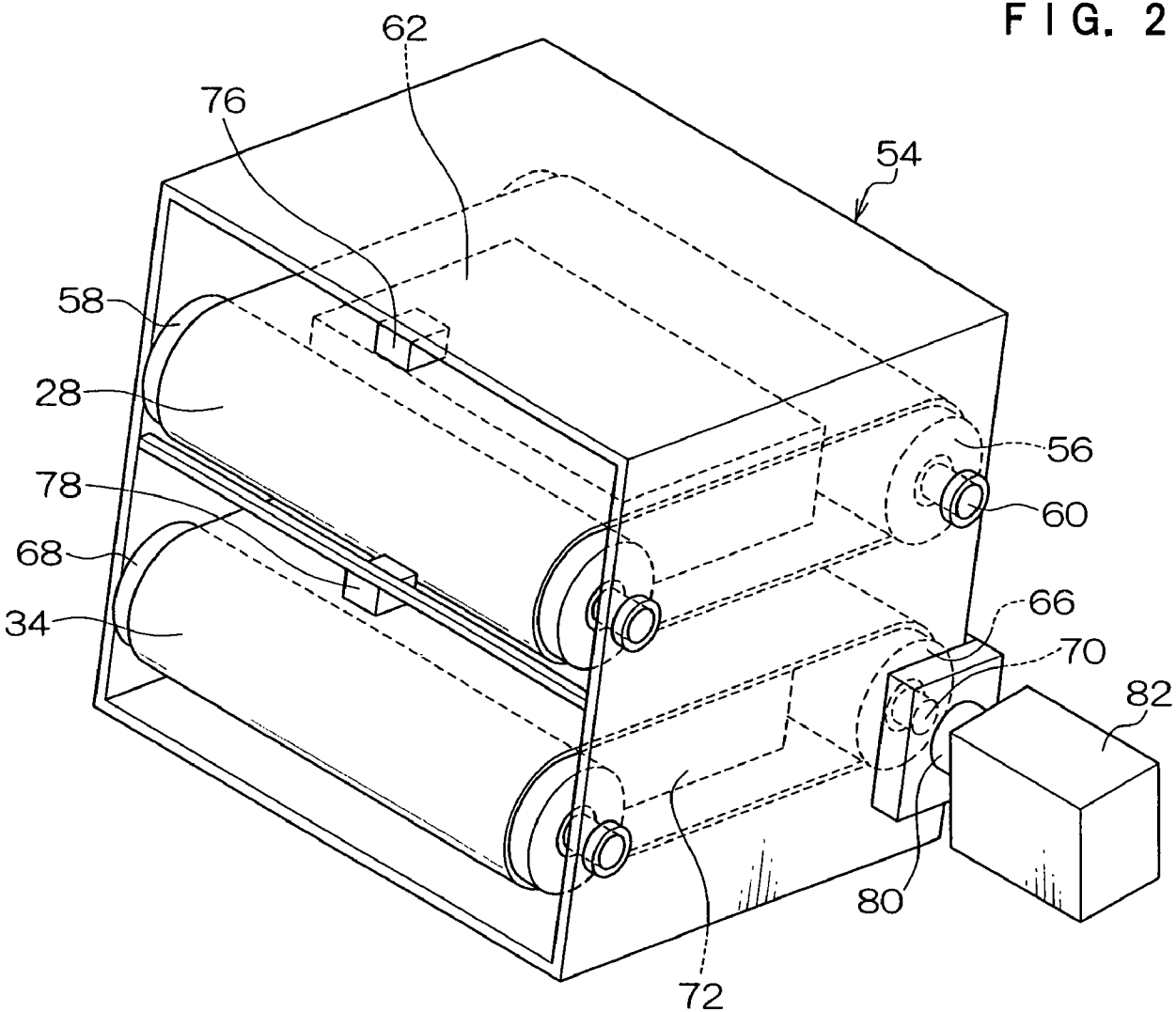
FIG. 2 is a perspective view showing a discharge conveyor belt and an inversion conveyor belt of the liquid droplet discharge apparatus pertaining to the embodiment of the invention.

As shown in FIGS. 1 and 2, the discharge conveyor belt 28 and the inversion conveyor belt 34 are housed inside a swinging holder 54 (frame) configured by cornered peripheral walls, such that the discharge conveyor belt 28 and the inversion conveyor belt 34 are disposed in two vertical tiers. The discharge conveyor belt 28 is stretched across a drive roll 56 and a driven roll 58, which are rotatably supported on the peripheral walls of the swinging holder 54. A drive motor (not shown) that is rotatable in one direction is disposed on a rotating shaft 60 of the drive roll 56, and the drive roll 56 is configured to be rotatable in one direction by the drive motor.

The inversion conveyor belt 34 is stretched across a drive roll 66 and a driven roll 68, which are rotatably supported on the peripheral walls of the swinging holder 54. A drive motor (not shown) that is rotatable forwardly and reversely is disposed on a rotating shaft 70 of the drive roll 66, and the drive roll 66 is configured to be rotatable in a forward direction and in a reverse direction by the drive motor.

The swinging holder 54 is configured to be opened at the portions where the drive rolls 56 and 66 and the driven rolls 58 and 68 of the discharge conveyor belt 28 and the inversion conveyor belt 34 are located. Thus, the paper P can be received or discharged by the discharge conveyor belt 28 or the inversion conveyor belt 34.

Figure 4:
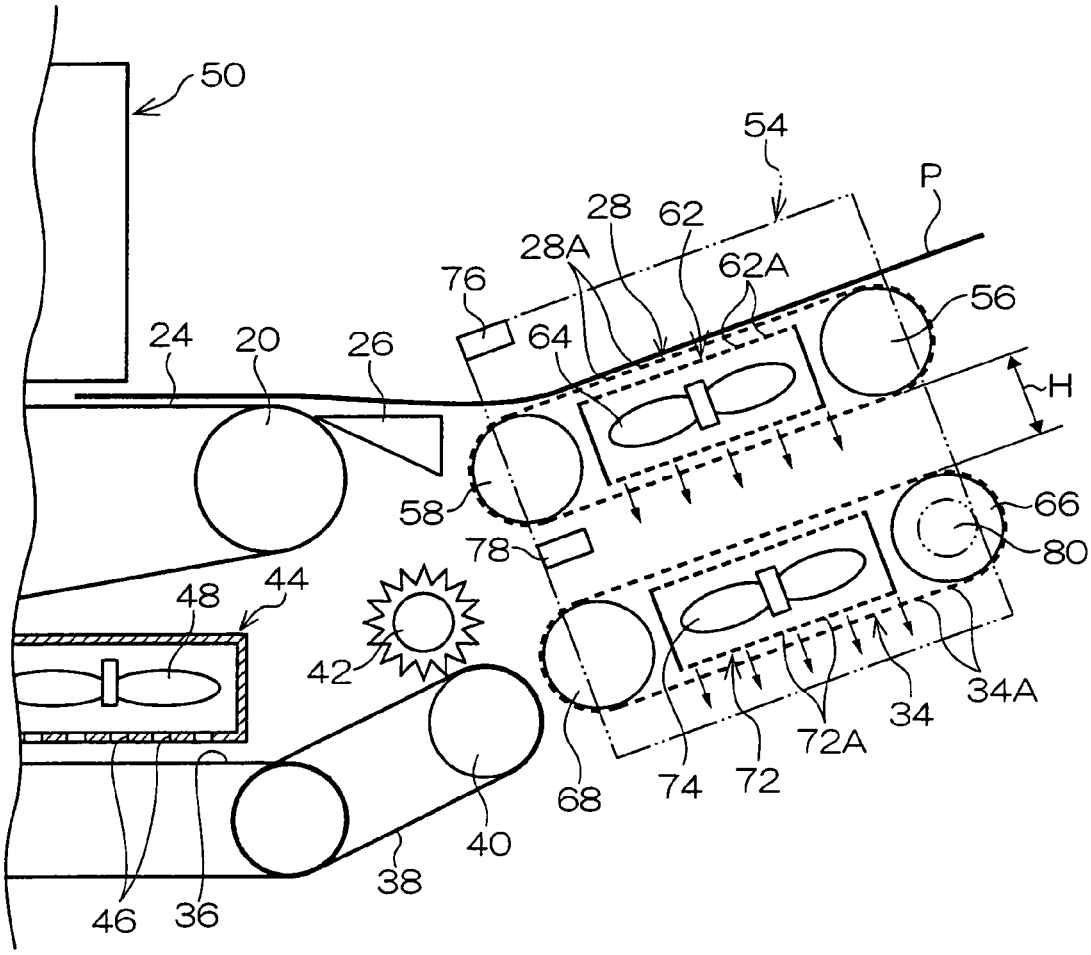
FIG. 4 is a side view showing a state where the discharge conveyor belt of the liquid droplet discharge apparatus pertaining to the embodiment of the invention is disposed in a paper receiving position of a conveyor belt, and shows a state where paper is conveyed by the discharge conveyor belt.

A box-like blower unit 62 is disposed between the drive roll 56 and the driven roll 58 of the discharge conveyor belt 28. A blower 64 serving as a second suction unit is disposed inside the blower unit 62. Plural hole portions 62A penetrate the upper and lower surfaces of the blower unit 62. As shown in FIG. 4, the wind formed by the blower 64 passes through plural hole portions 28A formed in the discharge conveyor belt 28 and is blown from the upper portion to the lower portion of the discharge conveyor belt 28.

Thus, suction force is imparted to the paper P conveyed by the discharge conveyor belt 28, so that the force with which the paper P is conveyed can be raised. The wind from the blower 64 is blown onto the paper P conveyed by the inversion conveyor belt 34, so that the force with which the paper P is conveyed by the inversion conveyor belt 34 is raised and the drying of the undried ink on the paper P is accelerated.

Similar to the discharge conveyor belt 28, a box-like blower unit 72 is disposed between the drive roll 66 and the driven roll 68 of the inversion conveyor belt 34. A blower 74 serving as a first suction unit is disposed inside the blower unit 72.

Plural hole portions 72A penetrate the upper and lower surfaces of the blower unit 72. As shown in FIG. 4, the wind formed by the blower 74 passes through plural hole portions 34A formed in the inversion conveyor belt 34 and is blown from the upper portion to the lower portion of the inversion conveyor belt 34. Thus, suction force is imparted to the paper P conveyed by the inversion conveyor belt 34, so that the force with which the paper P is conveyed can be raised.

It is preferable for the jet flow from the discharge conveyor belt 28 when the paper P is sucked and conveyed by the discharge conveyor belt 28 and the inversion conveyor belt 34 to be at least 80 m/sec., and it is preferable for the negative pressure accompanying the suction and conveyance of the discharge conveyor belt 28 and the inversion conveyor belt 34 to be at least 500 Pa.

Also, in consideration of cockling and curling of the paper P after printing and the potential core dimension of the jet flow resulting from the blower 64, it is preferable for the distance H (see FIG. 4) between the lower portion of the discharge conveyor belt 28 and the upper portion of the inversion conveyor belt 34 to be no greater than 5 mm.

A discharge sensor 76 and an inversion sensor 78 are respectively disposed above the driven roll 58 and the driven roll 68 of the swinging holder 54. The discharge sensor 76 and the inversion sensor 78 are configured to sense the passage of the paper P on the discharge conveyor belt 28 or the inversion conveyor belt 34.

The discharge sensor 76 and the inversion sensor 78 use a reflective light sensor, for example, include a light projector and a light receiver, and are configured to receive, with the light receiver, the light projected from the light projector. When the paper P is passing, the light from the light projector is reflected by the paper P and can be received with the light receiver, but when the paper P is not passing, the light projected from the light projector is not received within a predetermined amount of time. Thus, the end portion of the conveyed paper P can be detected.

Figure 3:
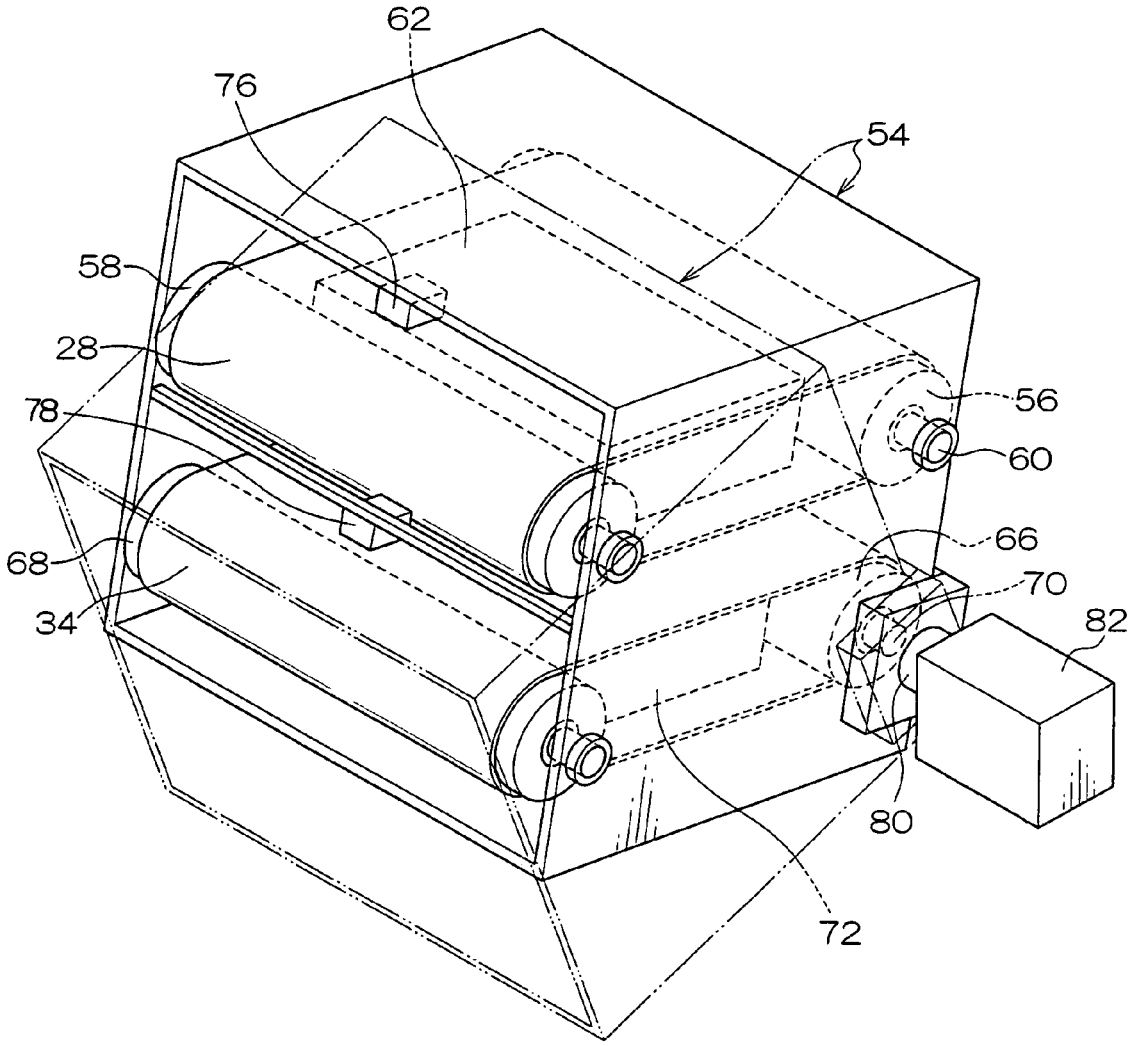
FIG. 3 is a perspective view showing the operation of a swinging holder to which are attached the discharge conveyor belt and the inversion conveyor belt of the liquid droplet discharge apparatus pertaining to the embodiment of the invention.

The swinging holder 54 is supported such that it is swingable with respect to the apparatus body 12 between the positions indicated by the solid lines and the hypothetical lines shown in FIG. 3. The position indicated by the solid lines in FIG. 3 corresponds to the state of the swinging holder 54 shown in FIG. 5. The position indicated by the hypothetical lines shown in FIG. 3 corresponds to the state of the swinging holder 54 shown in FIGS. 4 and 6. A rotating shaft 80 is disposed in the peripheral wall of the swinging holder 54 on a substantial extension line of a rotating shaft 70 of a drive roll 66. A stepping motor 82 is disposed on an end portion of the rotating shaft 80.

Figure 5:
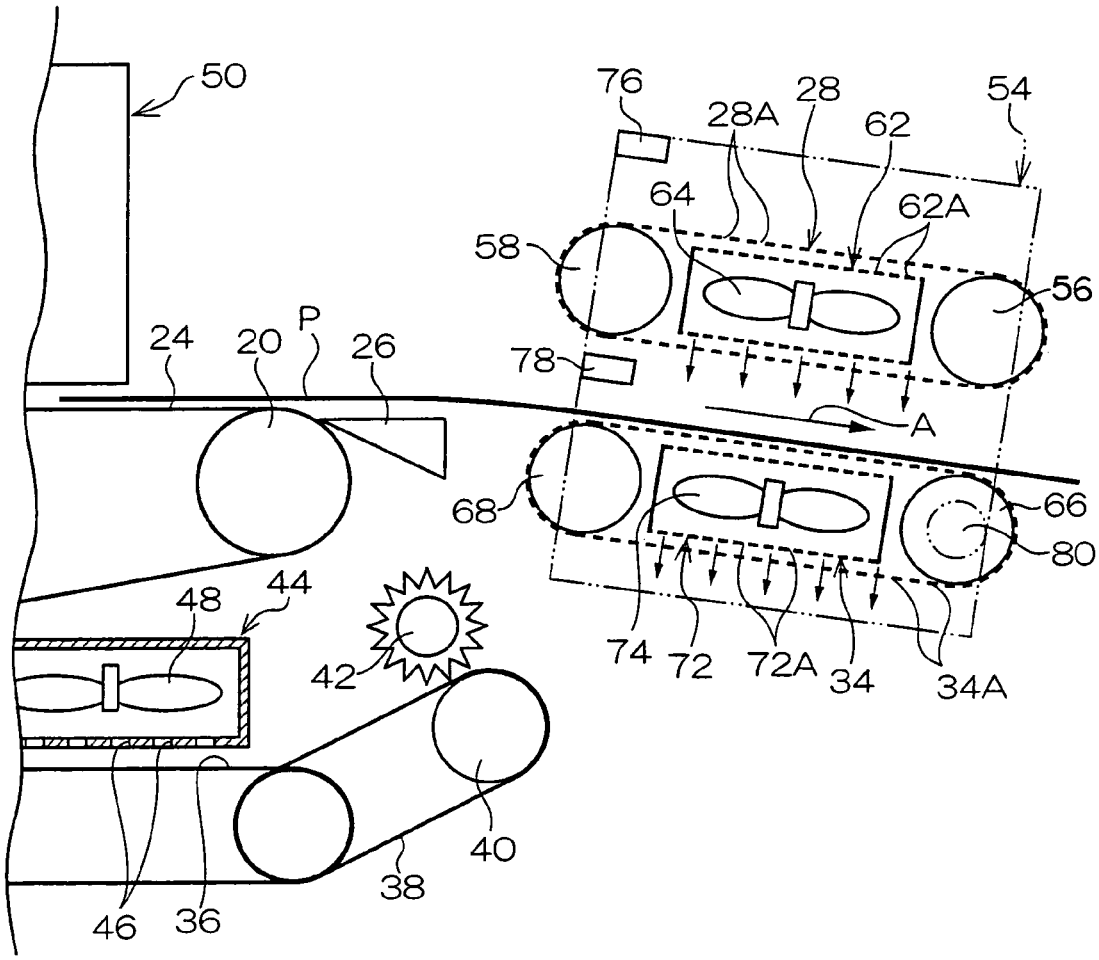
FIG. 5 is a side view showing a state where the inversion conveyor belt of the liquid droplet discharge apparatus pertaining to the embodiment of the invention is disposed in the paper receiving position of the conveyor belt, and shows a state where paper is conveyed by the inversion conveyor belt.
Figure 6:
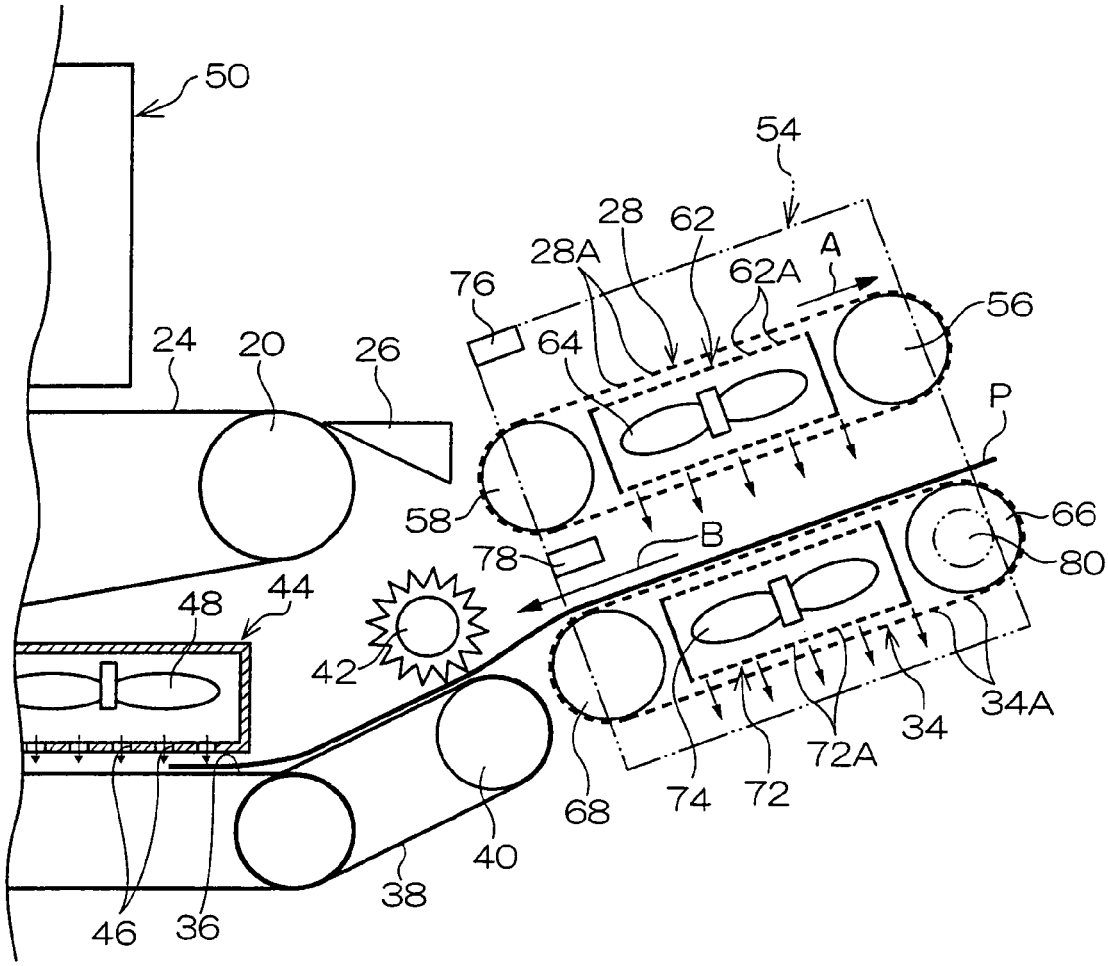
FIG. 6 is a side view showing a state where the discharge conveyor belt of the liquid droplet discharge apparatus pertaining to the embodiment of the invention is disposed in the paper receiving position of the conveyor belt, and shows a state where paper is conveyed to an intermediate conveyor belt.

The stepping motor 82 is configured to be forwardly and reversely rotatable within a predetermined angle. As shown in FIGS. 4 and 6, the discharge conveyor belt 28 is disposed in the paper feeding position of the conveyor belt 24, or as shown in FIG. 5, the discharge conveyor belt 28 evacuates from the paper feeding position of the conveyor belt 28 and the inversion conveyor belt 34 is disposed in the paper feeding position. When the discharge conveyor belt 28 is disposed in the paper feeding position of the conveyor belt 24, the inversion conveyor belt 34 is positioned in a position at which it can feed the paper P to the intermediate conveyor belt 38.

Figure 7:
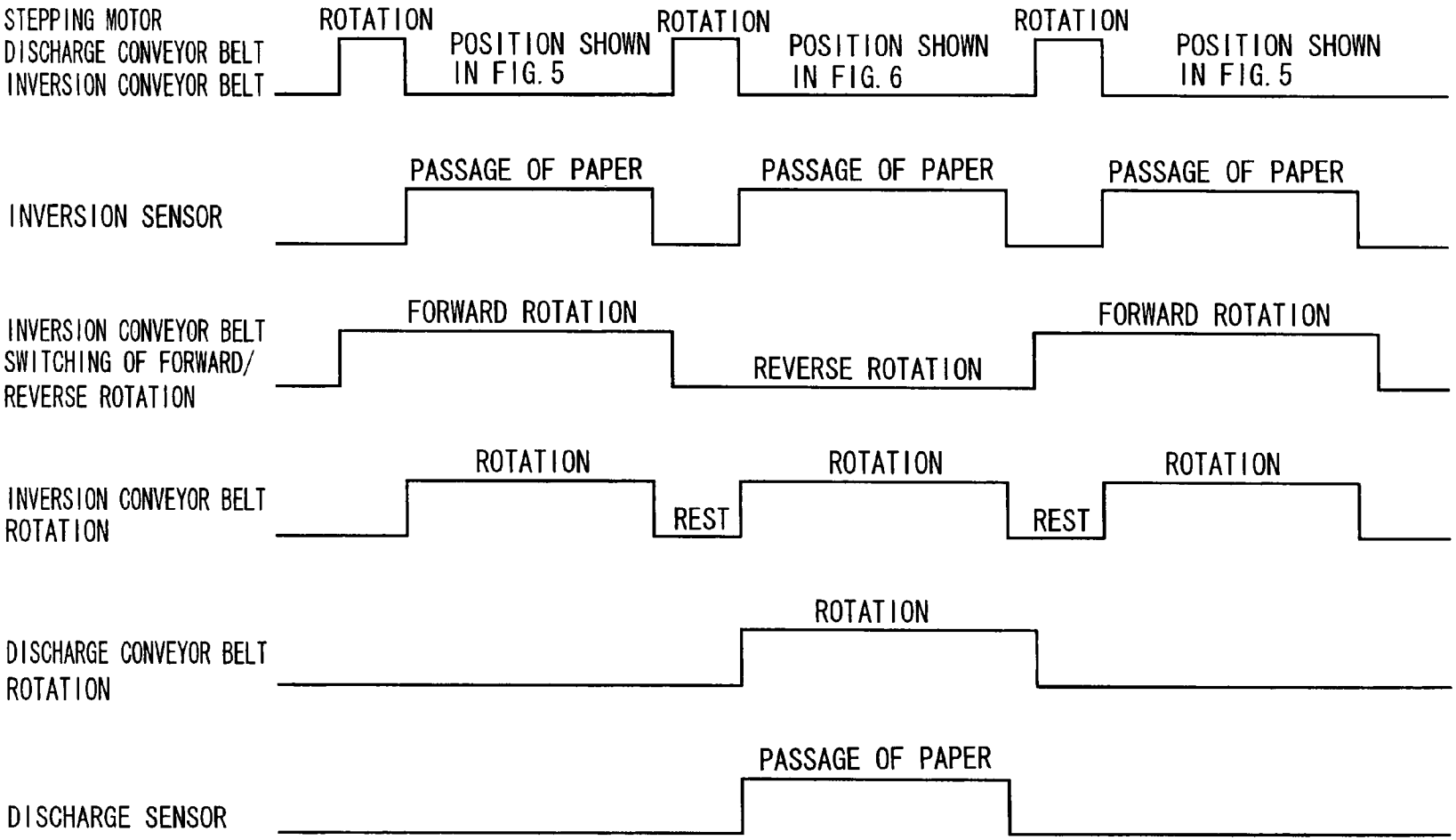
FIG. 7 is a timing chart showing the operation of the discharge conveyor belt and the inversion conveyor belt of the liquid droplet discharge apparatus pertaining to the embodiment of the invention.

Next, the action of the discharge conveyor belt 28 and the inversion conveyor belt 34 will be described with reference to FIG. 7.

First, the swinging holder 54 swings due to the rotation of the stepping motor 82, and the discharge conveyor belt 28 and the inversion conveyor belt 34 move to the positions shown in FIG. 5. In other words, the inversion conveyor belt 34 is disposed in the paper feeding position of the conveyor belt 24, and the paper P conveyed by the conveyor belt 24 and separated by the separation pawl 26 is fed onto the inversion conveyor belt 34.

In the inversion conveyor belt 34, switching of the rotation direction of the unillustrated drive motor is conducted synchronously with the rotation of the stepping motor 82, and the drive motor becomes forwardly rotatable. Then, the moving of the swinging holder 54 ends, the inversion conveyor belt 34 rotates, and the paper P on the inversion conveyor belt 34 is conveyed in the direction of arrow A. At this time, when the inversion sensor 78 detects that the trailing end of the paper P has passed below the inversion sensor 78, the drive motor (not shown) of the inversion conveyor belt 34 stops driving, and the paper P becomes retained on the inversion conveyor belt 34.

At this time, the paper P becomes adhered to the inversion conveyor belt 34 due to the suction force resulting from the blower 74 disposed inside the inversion conveyor belt 34. Also, the retention force of the paper P by the inversion conveyor belt 34 is raised and the drying of the undried ink on the paper P is accelerated due to the blowing force resulting from the blower 64 disposed inside the discharge conveyor belt 28.

Next, the stepping motor 82 rotates and the swinging holder 54 swings to the position shown in FIG. 6. In other words, the inversion conveyor belt 34 is disposed in a position where it can feed the paper P to the intermediate conveyor belt 38, the discharge conveyor belt 28 is disposed in the paper feeding position of the conveyor belt 24, and the paper P separated by the separation pawl 26 is fed onto the discharge conveyor belt 28.

In the inversion conveyor belt 34, switching of the rotation direction of the drive motor is conducted synchronously with the rotation of the stepping motor 82, and the drive motor becomes reversely rotatable. Then, the moving of the swinging holder 54 ends, the inversion conveyor belt 34 rotates, and the paper P on the inversion conveyor belt 34 is fed in the direction of arrow B.

At this time, the paper P is guided by the intermediate conveyor belt 38 and the spur 42. When the inversion sensor 78 detects that the trailing end of the paper P has passed below the inversion sensor 78, the drive motor (not shown) of the inversion conveyor belt 34 stops driving.

The movement of the swinging holder 54 ends, the discharge conveyor belt 28 rotates, and the paper P fed onto the discharge conveyor belt 28 is conveyed in the direction of arrow A and discharged to the discharge tray 30 via the discharge port 32. Here, when the discharge sensor 76 detects that the trailing end of the paper P has passed below the discharge sensor 76, the drive motor (not shown) of the discharge conveyor belt 28 stops driving after a predetermined time from the detection. The paper P is discharged to the discharge tray 30 from the discharge conveyor belt 28 within that period.

Next, the stepping motor 82 rotates, the swinging holder 54 swings to the position shown in FIG. 5, the inversion conveyor belt 34 is disposed in the paper feeding position of the conveyor belt 24, and preparation for the inversion operation of the next sheet of paper P is conducted.

Two-sided printing at a high speed becomes possible as a result of the above-described operation being repeated. In the present embodiment, the inversion conveyor belt 34 is moved, the paper P conveyed by the conveyor belt 24 and separated by the separation pawl 26 is received and temporarily retained, the inversion conveyor belt 34 is again moved, and the paper P is fed to the intermediate conveyor belt 38 that guides it to the two-sided conveyor belt 36, whereby the conveyance direction of the paper P can be switched without contacting the printing surface of the paper P. For this reason, even when two-sided printing is to be conducted at a high speed, the inversion conveyor belt 34 does not become soiled by the ink droplets adhering to the printing surface of the paper P.

Also, because the discharge conveyor belt 24 and the inversion conveyor belt 34 are attached to one swinging holder 54, it suffices simply to move the swinging holder 54 itself. Thus, the configuration is simplified and the production cost for the apparatus can be reduced.

In the present embodiment, the rotating shaft 80 is disposed on a substantial extension line of the rotating shaft 70 of the drive roll 60, and the axial center of the rotating shaft 80 becomes the center of rotation. However, the center of gravity of the swinging holder 54 may also be the center of rotation because it suffices as long as the swinging holder 54 is swingable.

Also, the swinging holder 54 is configured to be swingably moved, but the invention is not limited to this because it suffices as long as the discharge conveyor belt 28 and the inversion conveyor belt 34 can be respectively moved to the paper feeding position of the conveyor belt 24.

Figure 8:
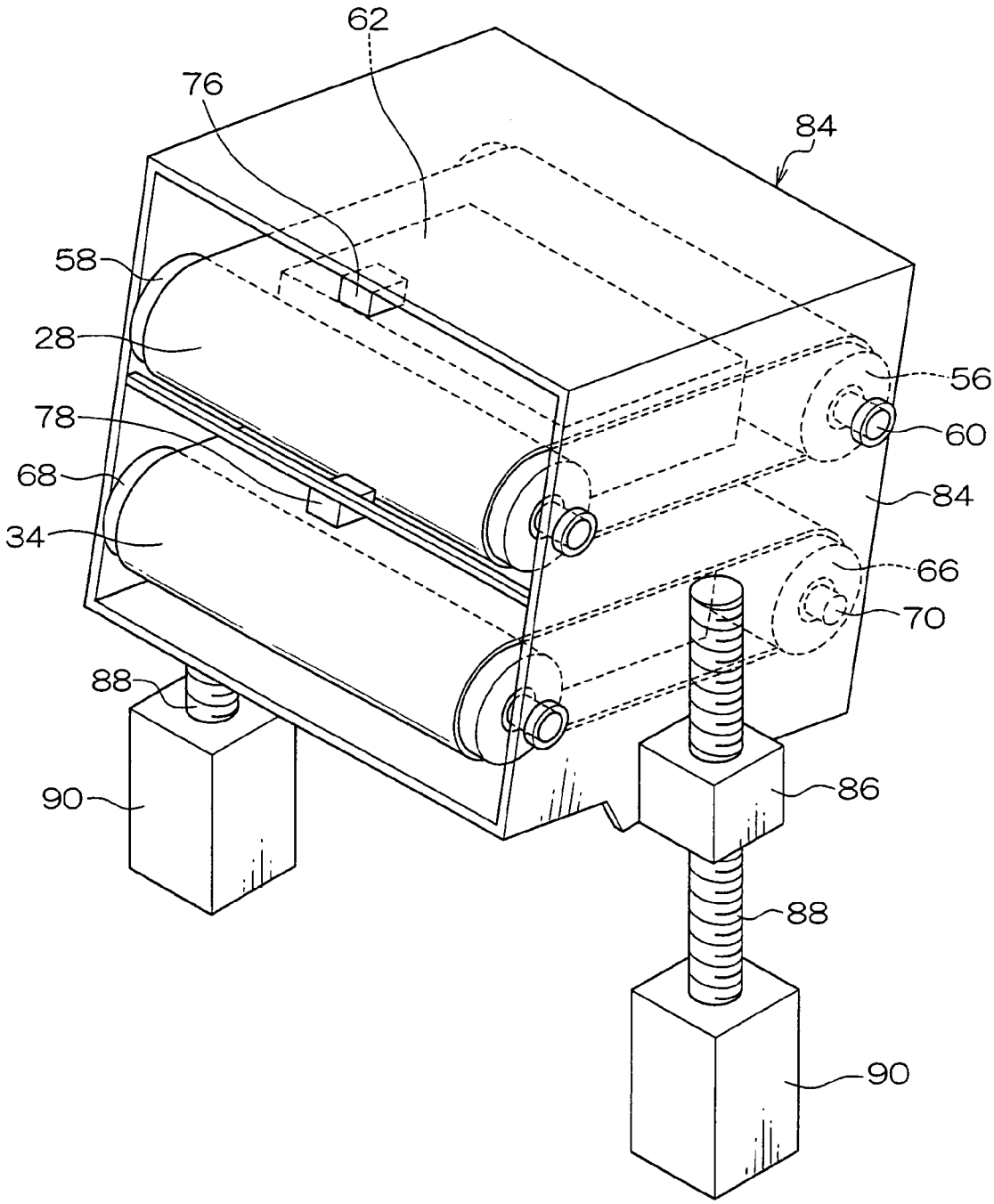
FIG. 8 is a perspective view showing a modification of the holder to which are attached the discharge conveyor belt and the inversion conveyor belt of the liquid droplet discharge apparatus pertaining to the embodiment of the invention.

For example, as shown in FIG. 8, the invention may also be configured such that nuts 86 are disposed on opposing peripheral walls of a holder 84, ball screws 88 are used, the ball screws 88 are rotated due to the forward rotation or reverse rotation of a motor 90, and the holder 84 is moved up and down via the nuts 86. In this case, the holder 84 may be moved using an unillustrated solenoid or with a rack and pinion mechanism.

Also, in the present embodiment, the discharge conveyor belt 28 and the inversion conveyor belt 34 are attached to one swinging holder 54 and the swinging holder 54 itself is moved, but it is not invariably necessary for the discharge conveyor belt 24 and the inversion conveyor belt 34 to be synchronized; the invention may also be configured such that the discharge conveyor belt 24 and the inversion conveyor belt 34 are individually movable.

Moreover, in the present embodiment, the two-sided conveyor belt 36 is disposed separately from the conveyor belt 24, but it is not invariably necessary to dispose the two-sided conveyor belt 36 because it suffices as long as the paper P can be printed on both sides. The invention may also be configured such that when printing is finished on one side of the paper P, the paper P is returned to below the conveyor belt 24 and inverted by the conveyor belt 24. However, in this case, it becomes necessary to dry the recording surface of the paper P while the P on one side of which printing has been conducted is received from the conveyor belt 24 and fed to below the conveyor belt 24 by the inversion conveyor belt 34.

Also, the configuration of the conveyance members that retain and convey the paper serving as the recording medium is not limited to the aforementioned endless belt members. The configuration may also be one which sucks and retains the paper on the outer peripheral surface of a roll member or drum member formed in a circular cylinder-like shape or circular column-like shape and is rotated and moved.

Also, the present invention is not limited to the aforementioned inkjet recording apparatus, and can also be applied to other liquid droplet discharge apparatus such as pattern forming apparatus that discharge liquid droplets onto a sheet-like substrate for pattern formation of semiconductors and liquid crystal displays, for example.

The present invention is described above in regard to a specific embodiment, but the present invention is not limited to this embodiment. Various other embodiments are also implementable within the scope of the invention.

The liquid droplet discharge apparatus of the present invention includes: conveyance member that retains and conveys a recording medium; a liquid droplet discharge head that discharges liquid droplets onto the recording medium retained on the conveyance member; a discharge member that moves to a recording medium feeding position of the conveyance member, receives the recording medium, and retains and conveys the recording medium to a discharge port; and an inversion member that moves to the recording medium feeding position, receives and retains the recording medium, and feeds the recording medium to an inversion path. The recording medium that has been printed on one side is fed by the inversion member to the inversion path, and two-sided printing is conducted.

In this aspect, the liquid droplet discharge apparatus may be configured such that the inversion member is disposed below the discharge member, and when the discharge member evacuates from the recording medium feeding position, the inversion member moves to the recording medium feeding position, receives and retains the recording medium, and feeds the recording medium to the inversion path.

Also, in this aspect, the liquid droplet discharge apparatus may be configured such that the inversion member is disposed such that it moves together with the discharge member, and when the discharge member evacuates from the recording medium feeding position, the inversion member moves to the recording medium feeding position, receives and retains the recording medium, and feeds the recording medium to the inversion path.

Thus, the conveyance direction of the recording medium can be switched without contacting the recording surface of the recording medium. For this reason, even when two-sided printing is to be conducted at a high speed, the inversion member does not become soiled by the liquid droplets adhering to the recording surface of the recording medium.

In this aspect, the liquid droplet discharge apparatus may be configured such that the inversion member comprises an inversion belt that can convey the recording medium, with the inversion belt forwardly rotating when it receives the recording medium from the conveyance member and reversely rotating when it feeds the retained recording medium to the inversion path.

Thus, the conveyance direction of the recording medium can be switched without contacting the recording surface of the recording medium. For this reason, even when two-sided printing is to be conducted at a high speed, the inversion belt does not become soiled by the liquid droplets adhering to the recording surface of the recording medium In this aspect, the liquid droplet discharge apparatus may be configured such that suction openings are formed in the inversion belt and air is sucked by a first suction unit, so that the recording medium is retained on the inversion belt.

Thus, the speed at which the recording medium is conveyed by the inversion belt can be raised.

In this aspect, the liquid droplet discharge apparatus may be configured such that the discharge member comprises a discharge belt that can convey the recording medium, with the recording medium being retained on the discharge belt as a result of air being sucked by a second suction unit from suction openings formed in the discharge belt.

Thus, the speed at which the recording medium is conveyed by the discharge belt can be raised.

Moreover, the liquid droplet discharge apparatus may be configured such that the air sucked by the second suction unit is discharged toward the inversion belt.

Thus, the recording medium is pushed against the surface of the inversion belt, whereby the speed at which the recording medium is conveyed by the inversion belt can be raised, and the drying of undried liquid droplets adhering to the recording surface of the recording medium can be accelerated.

The liquid droplet discharge apparatus may be configured such that the discharge belt and the inversion belt are attached to a same frame, with the frame being swung such that the discharge belt or the inversion belt is moved to the recording medium feeding position.

By attaching the discharge belt and the inversion belt to the same frame, the mechanism is simplified and the production cost for the apparatus can be reduced.

Moreover, the liquid droplet discharge apparatus may be configured such that the frame is moved up and down so that the discharge belt or the inversion belt is moved to the recording medium feeding position.

By moving up and down the frame to which the discharge belt and the inversion belt are attached, the mechanism can be further simplified.

According to the liquid droplet discharge apparatus of the present invention, the conveyance direction of the recording medium can be switched by the inversion belt without contacting the recording surface of the recording medium, so that even when two-sided printing is to be conducted at a high speed, the inversion belt does not become soiled by the liquid droplets adhering to the recording surface of the recording medium. By disposing suction openings in the inversion belt and in the discharge belt, air is sucked therethrough by respective suction units, whereby the force with which the recording medium is conveyed can be raised and two-sided printing can be conducted at a high speed. Further, the drying of undried liquid droplets adhering to the recording surface of the recording medium can be accelerated. Moreover, by attaching the discharge belt and the inversion belt to the same frame, the mechanism is simplified and the production cost for the apparatus can be reduced.

What is claimed is:

1. A liquid droplet discharge apparatus comprising:

a conveyance member that retains and conveys a recording medium;

a liquid droplet discharge head that discharges liquid droplets onto the recording medium retained on the conveyance member;

a discharge member that moves to a recording medium feeding position of the conveyance member, receives the recording medium, and retains and conveys the recording medium to a discharge port;

an inversion member that moves to the recording medium feeding position, receives and retains the recording medium, and feeds the recording medium to an inversion path;

a second suction unit that sucks air and discharges the air toward the inversion member, the second suction unit being disposed within the discharge member; and a swinging holder that includes the discharge member and the inversion member, the inversion member in the swinging holder being disposed adjacent and below the discharge member in the swinging holder, and the air sucked by the second suction unit from suction openings formed in the discharge member being discharged directly to the inversion member.

2. The liquid droplet discharge apparatus of claim 1, wherein the inversion member is disposed below the discharge member, and when the discharge member evacuates from the recording medium feeding position, the inversion member moves to the recording medium feeding position, receives and retains the recording medium, and feeds the recording medium to the inversion path.

3. The liquid droplet discharge apparatus of claim 1, wherein the inversion member is disposed such that it moves together with the discharge member, and when the discharge member evacuates from the recording medium feeding position, the inversion member moves to the recording medium feeding position, receives and retains the recording medium, and feeds the recording medium to the inversion path.

4. The liquid droplet discharge apparatus of claim 1, wherein the inversion member comprises an inversion belt that can convey the recording medium, with the inversion belt forwardly rotating when it receives the recording medium from the conveyance member and reversely rotating when it feeds the retained recording medium to the inversion path.

5. The liquid droplet discharge apparatus of claim 1, wherein the discharge member comprises a discharge belt that can convey the recording medium, with the recording medium being retained on the discharge belt as a result of the air being sucked by the second suction unit from suction openings formed in the discharge belt.

6. The liquid droplet discharge apparatus of claim 4, wherein the discharge member comprises a discharge belt that can convey the recording medium, with the recording medium being retained on the discharge belt as a result of the air being sucked by the second suction unit from suction openings formed in the discharge belt.

7. The liquid droplet discharge apparatus of claim 4, wherein the recording medium is retained on the inversion belt as a result of air being sucked by a first suction unit from suction openings formed in the inversion belt.

8. The liquid droplet discharge apparatus of claim 6, wherein the discharge belt and the inversion belt are attached to a same frame, with the frame being swung such that the inversion belt is moved to the recording medium feeding position.

9. The liquid droplet discharge apparatus of claim 6, wherein the discharge belt and the inversion belt are attached to a same frame, with the frame being moved up and down such that the inversion belt is moved to the recording medium feeding position.

10. The liquid droplet discharge apparatus of claim 1, including a two-sided conveyor belt disposed downstream from the inversion member and upstream of the inversion path, the two-sided conveyor belt conveying the recording medium from the inversion member to the inversion path.

11. The liquid droplet discharge apparatus of claim 1, including:

a two-sided conveyor belt disposed downstream from the inversion member and upstream of the inversion path;

the swinging holder swingably housing the discharge member and the inversion member; and a flow path for the recording medium from the conveyance member to the swinging holder, and then to the two-sided conveyor belt, which returns the recording medium to the conveyance member via the inversion path.

* * * * *